United States Patent [19]

Palinkas

[11] Patent Number: 5,008,788

[45] Date of Patent: Apr. 16, 1991

[54] MULTI-COLOR ILLUMINATION APPARATUS

[75] Inventor: John M. Palinkas, Harwinton, Conn.

[73] Assignee: Electronic Research Associates, Inc., Winsted, Conn.

[21] Appl. No.: 502,977

[22] Filed: Apr. 2, 1990

[51] Int. Cl.[5] ..... F21V 9/00

[52] U.S. Cl. ..... 362/231; 362/29; 362/800

[58] Field of Search ..... 362/29, 231, 248, 251, 362/800; 357/75, 17

[56] References Cited

U.S. PATENT DOCUMENTS 4,044,708 8/1977 Klein ..... 362/29 X
4,602,191 7/1986 Davila ..... 362/800 X

FOREIGN PATENT DOCUMENTS 2139340 11/1984 United Kingdom ..... 362/800

*Primary Examiner*—Stephen F. Husar
*Attorney, Agent, or Firm*—McCormick, Paulding & Huber

[57] ABSTRACT

A multi-color illumination apparatus for use in backlighting a liquid crystal display (LCD) device includes a substrate having a plurality of circuit paths made of electrically conductive foil leaf wherein the circuit path's configuration includes a number of tabs in a spaced relationship with one another and interleaved with tabs of an adjacent electrical circuit path. The tabs of one circuit path carry LED dies each of which produce a different color light with the anode of one and the cathode of the other connected to the tab. Leads connect the cathode of one and the anode of the other to the tabs of the adjacent circuit path. The second electrical circuit path also includes tabs in a spaced relationship with one another and located in registry with the tabs of the first electrical circuit path and also carry LED dies forming a second LED color pair. The second LED color pair is connected to tabs of a third electrical circuit which tabs are interleaved with the tabs of the second electrical circuit path. A light frame surrounds the outer peripheral marginal area of the substrate and diffuser tape covers the light frame and substrate below. A layer of reflective white ink covers the substrate surface and has openings in registry with the location of the LED color pairs.

14 Claims, 2 Drawing Sheets

MULTI-COLOR ILLUMINATION APPARATUS

BACKGROUND OF THE INVENTION

The present invention relates generally to illumination devices and deals more specifically with a multi-color illumination device for use in backlighting a liquid crystal display (LCD) device.

It is well known in the art to provide backlighting for LCD devices which are either transmissive or transflective to provide a background against which the activated elements of the LCD are contrasted enabling a viewer to see the graphic, image or message displayed. The operation of LCD devices are well known to those skilled in the art and a more detailed description of their operation may be sought by reference to text books, literature and reference information available in the trade.

One well known drawback to LCD devices is the difficulty in viewing displayed images or messages and the like in very low light applications such as nightfall or dimly lit areas.

Since the human eye's sensitivity to red light is lower than its sensitivity to yellow/green light, displays having light in the red frequency spectrum allows the eye to adapt more readily in low light or nighttime applications. The human eye being more sensitive to yellow/-green light makes light in the yellow/green frequency spectrum more suitable and visible in higher ambient light conditions.

It would be desirable therefore, to provide a multi-color illumination apparatus that may be used as backlighting for an LCD device to permit images, graphics, messages and the like to be more readily visible in differing light environments.

Conventional bi-color LED are generally well known and typically comprise LED dies bonded to respective ends of the leads of the device. A diffuser material forms a cap and encapsulates the leads and the dies to provide structural integrity and also to act as a light diffuser. Such conventional LED have a high profile and are generally unsuitable for backlighting applications.

It is a general aim of the present invention to provide a multi-color illumination apparatus that overcomes disadvantages of known multi-color lamps by providing a multi-color illumination apparatus that has a very low profile and on which uses diffusion tape to achieve uniform light distribution and avoid the light attenuation generally introduced by diffusion material used with conventional bi-color LEDs.

It is a further aim of the present invention to provide a multi-color illumination device which may be used as an alarm indicator, annunciator, attract mode device and in other applications in which a change of color is used as an indicating means to represent a given external condition.

SUMMARY OF THE INVENTION

An LED multi-color illumination apparatus for use in backlighting a liquid crystal display (LCD) in accordance with the present invention is presented and includes a substrate having a generally planar surface carrying a plurality of electrical circuit paths formed by an electrically conductive foil leaf. The circuit paths are configured with tabs arranged in a spaced relationship with one another and interleave one-for-one with tabs of an adjacent electrical circuit path formed by the foil leaf. Tabs on a first electrical circuit path along the marginal area of one side of the substrate carry LED dies each of which emit a different color light and define an LED color pair. The anode of one and cathode of the other LED dies are physically and electrically connected to the foil leaf area of the first circuit path. The cathode of the first and the anode of the second LED dies are connected by leads bonded to the dies and to adjacent tab areas of the second electrical circuit path. The second circuit path is adjacent the first and includes a plurality of tabs disposed oppositely from the marginal side of the substrate containing the first electrical circuit path and in general registry with the tabs of the first electrical circuit path. The tabs carry LED dies wherein the respective anode of one and the cathode of the other are physically and electrically connected with the surface of the foil defining the tab. A third electrical circuit path adjacent the second is formed from the foil leaf and is located along the marginal area opposite the marginal area of the substrate carrying the first electrical circuit path. The third circuit path includes a number of tabs in a spaced relationship with one another and which are interleaved with the tab areas of the second electrical circuit path. Leads from the respective cathodes and anodes of the LED dies comprising the LED color pair located on the tab areas of the second electrical circuit path are connected to the tabs of the third electrical circuit path and complete a series circuit made up of the first electrical circuit path, the first LED color pair, the second electrical path, the second LED color pair and the third electrical circuit path.

The invention further includes a reflective white masking layer of white ink or white paint which covers the surface of the substrate and the foil paths and includes a number of openings in registry with the location of the LED color pairs.

The invention also includes a light frame mounted on the substrate along the marginal peripheral area of the substrate and extending upwardly from the substrate surface. The light frame has an interior surface wall slanting upwardly and outwardly from the substrate surface toward an upper surface edge of the light frame. Diffusing tape is attached to the upper surface edge and substantially covering the substrate and LED color pairs to uniformly diffuse light that is emitted from the LEDs.

Means are also provided for connecting an electrical voltage potential in series with the electrical circuit paths so that a voltage potential having a first polarity excites the LED color pairs to produce a first color light and applying a voltage potential having a second polarity excites the LED color pairs to produce a second color light. Application of a voltage potential having an alternating polarity produces a third color light.

BRIEF DESCRIPTION OF THE DRAWINGS

The above and other features and advantages of the present invention will become readily apparent from the following written description and drawings wherein.

DETAILED DESCRIPTION OF PREFERRED EMBODIMENT

Turning now to the drawings, the multi-color display apparatus of the present invention is illustrated as it typically might be used to provide backlighting for a liquid crystal display (LCD) device and is shown generally as 10. The LCD device is shown in phantom generally at 12 and may be a transmissive or transflective type having alphanumeric segmented sections, graphics or other images, all of which are well known to those skilled in the art as well as the operation of the LCD device. It is sufficient for purposes of explanation of this invention that the LCD device 12 is positioned in close proximity to the multi-color illumination apparatus 10 which provides the backlighting for the LCD so that the activated portions or segments of the LCD are visible by a viewer due to the light shown generally by the arrows 14,14, emitted from the multi-color illumination apparatus 10 or prior known lighting devices.

Figure 1:
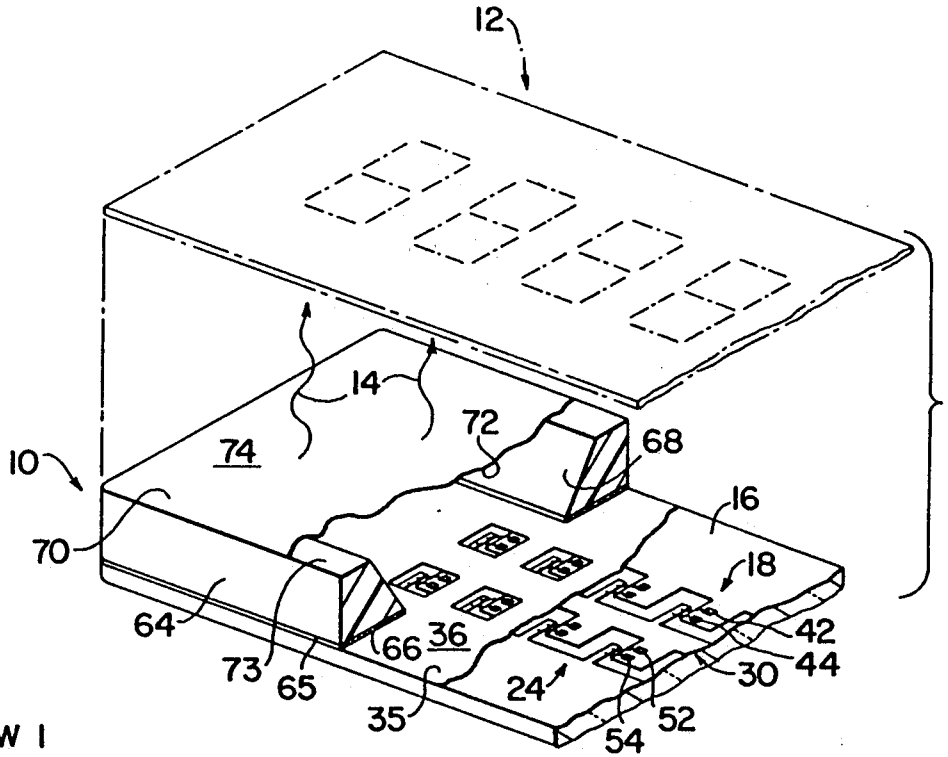
FIG. 1 is a perspective, cut-away view of the multi-color backlighting apparatus of the present invention mounted in a light frame and typically positioned with an LCD device for illumination of the LCD.
Figure 2:
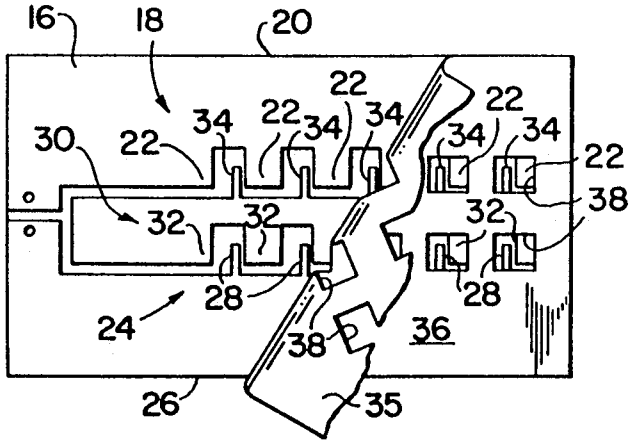
FIG. 2 is a top plan view of the substrate with the reflective white ink layer rolled back to reveal the foiled circuit paths upon which the LED dies and electrical connections are bonded.
Figure 3:
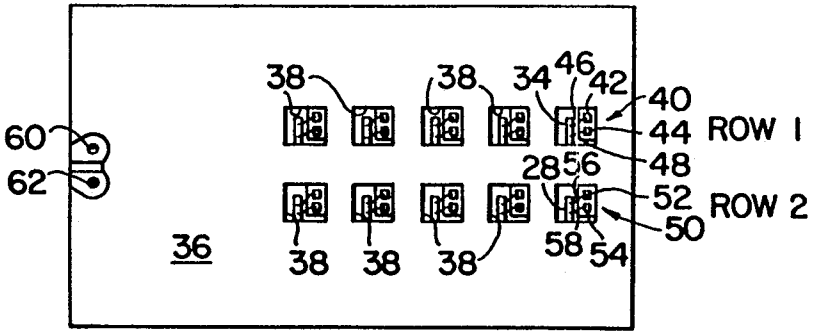
FIG. 3 is a top plan view of the multi-color illumination apparatus of the present invention with the LED color pairs bonded thereto and with the substrate painted with the reflective white ink layer.

Turning additionally now to FIGS. 2 and 3 and still referring to FIG. 1, FIG. 2 illustrates a substrate 16 which may be of a glass nematic or other such material used in the printed circuit art. The surface of the substrate 16 has printed thereon electrically conductive foil leaf which defines a number of electrical circuit paths by which voltages are distributed and impressed across the LED dies in the proper polarity to cause the LED dies to emit light as described below. In FIG. 2, one circuit path is represented by the foil pattern 18 which extends longitudinally along the marginal length 20 of the substrate 16 and includes projecting tabs 22,22 which extend in a direction inwardly from the marginal area 20 and in a spaced relation with adjacent tabs. The tabs 22,22 form foil land areas to which the LED dies are physically and electrically connected as discussed in further detailed below. A second electrical circuit path represented by the foil pattern 24 extends longitudinally along the marginal length 26 of the substrate 16, the marginal length 26 being disposed generally opposite the marginal area 20. The foil pattern 24 includes projecting tabs 28,28 which extend in a direction inwardly from the marginal area 26 and which provide an electrical and physical connection to additional LED dies which are mounted on adjacent foil land areas formed by a third foil circuit pattern 30.

The foil circuit pattern 30 lies intermediate the foil patterns 18 and 24 and includes downwardly projecting tabs 32,32 in a spaced relation with one another and disposed oppositely the inwardly projecting tabs 22,22 of the foil pattern 18. The tabs 28,28 of the foil pattern 24 are interleaved with the tabs 32,32 of the foil pattern 30. The foil pattern 30 additionally includes tabs 34,34 which extend in a direction towards the marginal area 20 and between respective tabs 22,22 of the foil pattern 18 to form an interleaved arrangement with the tabs 22,22.

Each of the foil patterns 18, 24 and 30 are physically and electrically isolated from one another. The foil patterns 18, 24 and 30 are formed on the substrate 16 utilizing well known printed circuit board techniques or other suitable means well known to those skilled in the art.

The foil patterns 18, 24 and 30 as well as the substrate 16 are coated or covered with a layer 35 of white ink or white paint having a surface 36 which provides high light reflectivity, that is, any light incident on the surface 36 is reflected from the surface. The white ink layer 35 is shown rolled back to reveal the underlying substrate 16 and the foil patterns 18, 24 and 30. The white ink layer 35 is preferably pure white and includes a matrix of openings 38,38 to reveal the foil tabs 22, 34, 28, 32 which are in registry with the openings 38,38. The coating of the substrate surface with the white ink or paint layer 35 may be accomplished in any suitable manner well known to those skilled in the art including techniques similar to that of solder masking.

As illustrated in FIGS. 2 and 3, the substrate 16 and associated foil patterns are arranged to provide a two row by five column matrix arrangement. The number of columns may be increased to any desired number by increasing the longitudinal length of the foil circuit paths 18, 24 and 30. The number of rows may be expanded by increasing the number of foil circuit paths 30 intermediate the marginal foil circuit path 18 and 24. The electrical connections of a number of the different LED color pairs to form a desired matrix arrangement is discussed in further detail in connection with the discussion of FIGS. 4 and 5.

An LED color pair in row 1 as shown in FIG. 3, is generally represented at 40 and comprises a first LED die 42 and a second LED die 44, each die 42,44 emitting light in a different frequency spectrum when excited by the application of a voltage in the proper polarity across the terminals of the LED. For example, LED die 42 may emit red light when excited by a voltage having the proper polarity and magnitude and LED die 44 may emit green light when excited by a voltage having the proper polarity and magnitude. The LED color pair dies 42,44 are mounted to the tabs 22,22 of the foil pattern 18 in a side-by-side arrangement such that typically, the anode of the LED die 42 is in electrical contact with the foil surface of the tab 22 and the cathode of the LED die 44 is in electrical contact with the foil surface of the tab 22 thereby providing a common connection between the anode of the die 42 and the cathode of the LED die 44. The anode of the LED die 42 is connected to the foil surface of the tab 34 by a lead 46. The anode of the LED die 44 is connected to the foil surface of tab 34 by a lead 48. The connection of the LED dies 42,44 to the foil surface of the tab 22 and the connection to the foil surface of the tab 34 by leads 46 and 48, respectively are made using techniques well known to those skilled in the art. The LED color pair 40 is repeated at each of the respective adjacent foil surface tab areas 22 and 34 along row one.

A second LED color pair in row two, as shown in FIG. 3, is generally represented at 50 and comprises LED color dies 52 and 54, respectively each emitting a different color light and corresponding to the different color lights emitted by the LED color dies 42 and 44. Preferably, the LED color die 52 emits the same color as the LED color die 44 and the LED color die 54 emits the same color light as the LED color die 42. The LED dies 52,54 comprising the LED color pair 50 are electrically connected to the foil surface of the tab 32 in a similar manner as the dies comprising the color pair 40 described above with the cathode of the LED die 52 being in common with anode of the LED die 54. The respective anode and cathode of the LED die 52 and 54 are connected to the foil surface of tab 28 by leads 56,58 respectively and which connection is made in a similar manner as that described above for the LED color pair 40. The connection pattern of the LED color pair 50 is repeated along row two.

It will be recognized and appreciated that the LED color pair 40 is in electrical series with the LED pair 50 and forming a series circuit with the electrical circuit path 18, 30 and 24.

The respective LED dies of the LED color pair 40,50 are excited to cause them to emit light when a voltage of the proper polarity and magnitude is applied to the electrical circuit paths defined by the foil patterns 18 and 24 respectively. A voltage is applied to the foil circuit paths 18,24 respectively at the input connections 60,62. A more detailed discussion of the electrical operation is presented below in connection with FIGS. 4 and 5. It is sufficient to say that when a voltage having the proper polarity and magnitude is applied to the inputs 60 and 62, the LED dies 42 and 54, respectively emit light. If the polarity of the voltage at the inputs 60 and 62 is reversed, then LED dies 44 and 52 respectively emit light. When an alternating voltage potential is applied to the input 60,62 then the LED dies 50 and 54 alternate emitting light with the LED dies 44 and 52 and produce a third color which is a combination of the primary color light emitted by the individual LED dies.

Referring to FIG. 1, a cut-away perspective view of the multi-color illumination apparatus is shown therein and includes a light frame 64 peripherally surrounding the LED color pairs and mounted to the surface 36 of the white ink layer 35 by means of an adhesive layer or tape 66 between the bottom peripheral surface 65 of the light frame and the surface 36 or by other adhesion means well known to those skilled in the art. The light frame 64 is preferably a white plastic material and includes an inner wall 68 which slopes upwardly and outwardly from the surface 36 to maximize the amount and uniformity of the emitted light transmitted through and diffused by diffuser tape 70. The tape 70 has its lower surface 72 in contact with the upper peripheral edge surface 72 of the light frame 64 to provide a substantially air tight and waterproof seal between the outer surface 74 of the diffuser tape and the white ink surface 36 of the substrate 16. It should be noted that light diffusion is provided by the combination of the tape 70, light frame 64 and the reflective white ink surface 36 without the requirement of a solid diffusion material typically used in conventional LED and other known lighting devices and which diffusion material attenuates the light intensity produced by the light source.

Figure 4:
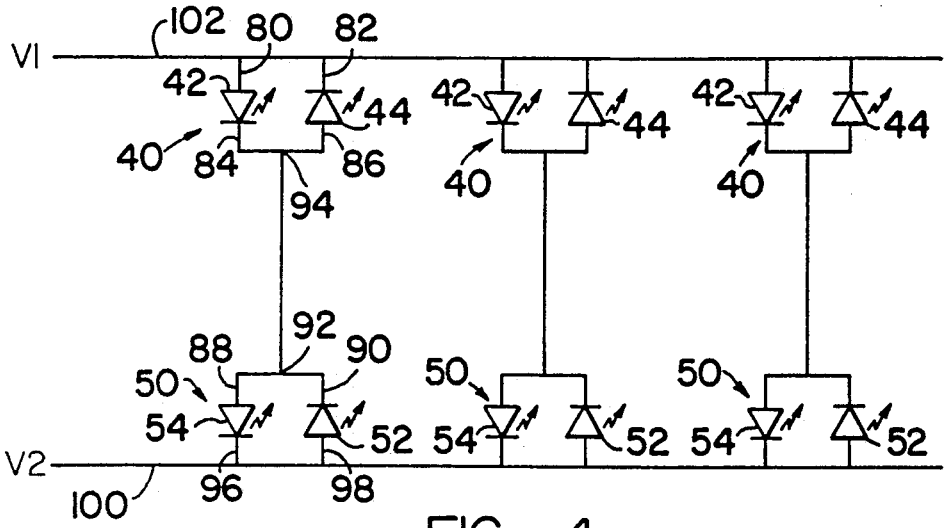
FIG. 4 illustrates a typical electrical connection of a number of different LED color pairs to form a two row by three column matrix arrangement.
Figure 5:
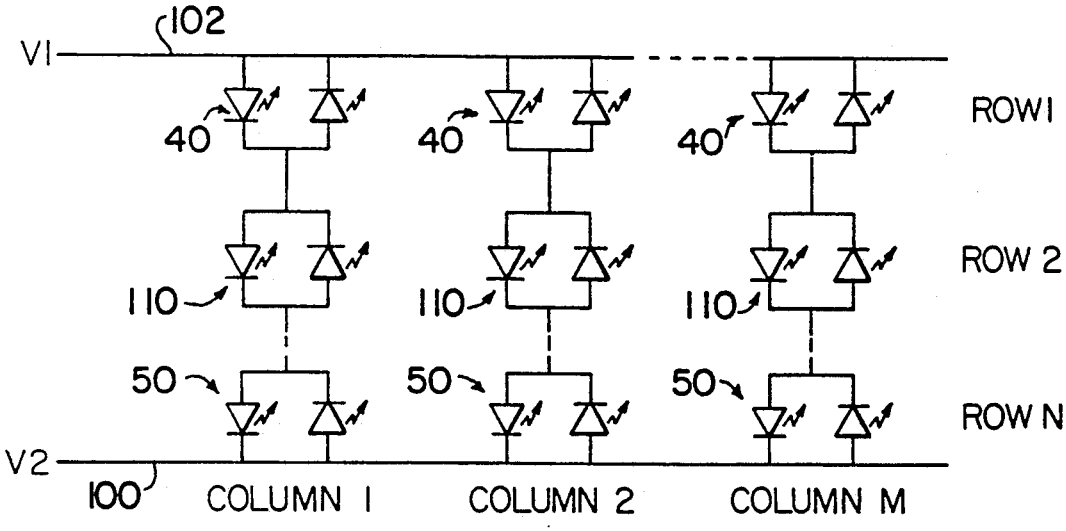
FIG. 5 illustrates a typical electrical connection of a number of different LED color pairs to form an N row by M column matrix arrangement.

Turning now to FIGS. 4 and 5, FIG. 4 illustrates a typical electrical connection of a number of different LED color pairs to form a two row by three column matrix arrangement. For purposes of consistency and comparison, the respective LED dies are given the same reference numbers as used in FIGS. 1 and 3. Referring to FIG. 4, LED color pair 40 is illustrated with the anode 80 of LED die 42 connected to the cathode 82 of LED die 44. The cathode 84 of LED die 42 is connected to the anode 86 of LED die 44. The anode 88 of LED die 54 of the color pair 50 is connected to the cathode 90 of the LED die 52 to form a junction 92 and which junction is connected to the junction 94 formed by the cathode 84 and anode 86 of the respective LED dies 42 and 44. The cathode 96 of the LED 54 is connected to the anode 98 of the LED die 52 and to the voltage reference bus 100. The anode 80 and cathode 82 of the LED dies 42 and 44 respectively are connected to the voltage reference bus 102.

It will be seen that a DC voltage applied to the respective voltage reference buses 102 and 100 in the proper polarity and magnitude will cause the LED dies 42 and 54 of the LED color pairs 40 and 50 respectively to emit light, for example, red. The respective LED dies 44 and 52 of the color pairs 40 and 50 respectively will be reversed biased and therefore not emit light. By reversing the polarity of the DC voltage applied to the voltage reference bus 102 and 100 respectively, the LED die 44 and 52 of the respective color LED color pairs 40 and 50 will now be forward biased and emit light, for example green light. The LED dies 42 and 54 of the respective color pairs 40 and 50 are now reversed biased and will not emit light. It can thus be seen that by applying a voltage across the voltage reference buses 102 and 100 of the proper magnitude and polarity, a multi-color light is produced by the lighting apparatus of the present invention.

Likewise, applying an alternating AC voltage across the voltage reference buses 102 and 100 respectively will cause the LED dies of each respective LED color pair 40 and 50 to alternately become forward biased and reversed biased thereby emitting light for a portion of the alternating voltage cycle thereby combining the two colors to produce a third color light which is a combination of the first two. It will be recognized that a feature of the present invention allows the generation of a third color light which is a combination of the two colors provided by the respective different color LED dies of a color pair. The combination of the two is variable and controlled by the magnitude and duration of the voltage potential applied in the given proper polarity, for example, a voltage may be applied with a pulse width modulation to produce a continually varying third color light.

Turning now to FIG. 5, a typical electrical connection of a number of different LED color pairs to form an N row by M column matrix arrangement is illustrated therein wherein LED color pairs 40 and 50 are similar to the LED color pairs 40 and 50 described above. Additional color pairs may be connected in series with the LED color pairs 40,50 as illustrated wherein a third LED color pair, generally designated 110, is illustrated connected in electrical series with the LED color pairs 40 and 50, respectively. The connection of LED color pairs in series in each column permit the size of the multi-color illumination apparatus to be increased to N rows. Additional series combinations of the LED color pairs connected in parallel permit expansion of the matrix arrangements to M columns and accordingly, expansion of the surface illumination area. It will be recognized that as the number of LED color pairs in series increases, the magnitude of the voltage applied across the voltage reference buses 102 and 100 respectively must increase in magnitude to forward bias the increased number of diodes in the series connection.

A multi-color illumination apparatus particularly useful for backlighting an LCD device has been described above in several preferred embodiments. It will be recognized by those skilled in the art that variations of the embodiments described may be made without departing from the spirit and scope of the invention and therefore, the invention has been disclosed by way of illustration rather than limitation.

What is claimed:

1. Multi-color illumination apparatus, comprising:

substrate means having a generally planar surface for carrying foil leaf means defining a plurality of electrical circuit paths;

at least one first light diode (LED) means for emitting light of a first color in response to a first excitation voltage signal applied to the LED;

at least one second light emitting diode (LED) means for emitting light of a second color in response to a second excitation voltage signal applied to the LED;

said first and second LED's defining an LED color pair;

reflective white masking means for covering said surface of said substrate means and having openings therethrough whereby the area of said substrate surface in registry with said openings in said white masking means is exposed;

one electrical circuit path of said plurality including a first plurality of foil leaf areas arranged in a spaced relation to one another and defining a first electrical circuit path for physically and electrically connecting the anode of said first or second LED of one LED color pair and the cathode of the other of said first or second LED of said one LED color pair to one another and to said first electrical circuit path;

a second electrical circuit path of said plurality including a second plurality of foil leaf areas, a first portion of said plurality of foil leaf areas arranged in a spaced relation to one another and one-for-one with said first plurality of foil leaf areas defining said first electrical circuit path, said first portion of said second plurality of foil leaf areas comprising said second electrical circuit path and being electrically connected to the cathode of said first or second LED of said one LED color pair and the anode of the other of said first or second LED of said one LED color pair;

said second plurality of foil leaf areas including a second portion of foil leaf areas disposed generally oppositely said first portion and substantially in registry with said first plurality of foil leaf areas, said second portion of foil leaf areas being arranged in a spaced relation to one another and physically and eclectically connecting the anode of said first or second LED of a second LED color pair and the cathode of the other of said first or second LED of said second LED color pair to one another and to said second electrical circuit path;

a third electrical circuit path of said plurality including a third plurality of foil leaf areas arranged in a spaced relation to one another and one-for-one with said second portion of foil leaf areas and substantially in registry with said first portion of foil leaf areas of said second plurality of foil leaf areas, said third plurality of foil leaf areas being electrically connected to the cathode of said first or second LED of said second LED color pair and the anode of the other of said first or second LED of said second LED color pair, and said one and second LED color pairs being located substantially in registry with said openings in said white masking means.

2. Multi-color illumination apparatus as defined in claim 1 further including means defining a light frame extending generally in a direction away from said substrate surface and located along the peripheral marginal area of said substrate.

3. Multi-color illumination apparatus as defined in claim 2 further including means for diffusing light emitted by said first and second LED color pairs.

4. Multi-color illumination apparatus as defined in claim 3 wherein said diffusing means comprises diffusion tape disposed opposite said substrate surface and in contact with an upper peripheral edge surface of said light frame.

5. Multi-color illumination apparatus as defined in claim 2 wherein said light frame includes an interior wall surface extending in a direction generally away from said substrate surface and toward the peripheral marginal area of said substrate to form an outwardly slanting surface whereby light from said reflective white masking means and said first and second LED color pairs incident on said interior wall surface is directed upwardly away from said substrate surface.

6. Multi-color illumination apparatus as defined in claim 1 wherein said reflective white masking comprises a layer of white ink.

7. Multi-color illumination apparatus as defined in claim 1 wherein said reflective white masking means comprises a layer of white paint.

8. Multi-color illumination apparatus as defined in claim 1 further comprising a plurality of one and second LED color pairs and forming a 2 row by N column matrix arrangement wherein N represents the number of electrical series circuits formed by the connection of said one and second LED color pairs.

9. Multi-color illumination apparatus as defined in claim 1 further comprising:

at least two of said second electrical paths wherein said first portion of said plurality of foil leaf areas of said second of said at least two of said second electrical circuit paths being interleaved and in a spaced relation to said second portion of said plurality of foil leaf areas of said first of said at least two of said second electrical circuit paths, and a third LED color pair associated with the second of said at least two of said second electrical circuit paths, said third LED color pair being connected in an electrical series circuit with said one and second LED color pairs and forming an M row by N column matrix arrangement wherein M represents the number of LED color pairs connected in said electrical series circuit and N represents the number of said electrical series circuits.

10. A multi-color illumination apparatus for backlighting a liquid crystal display (LCD) device, said apparatus comprising:

substrate means having a generally planar surface for carrying foil leaf means defining a plurality of electrical circuit paths;

at least one first light diode (LED) means for emitting light of a first color in response to a first excitation voltage signal applied to the LED;

at least one second light emitting diode (LED) means for emitting light of a second color in response to a second excitation voltage signal applied to the LED;

said first and second LED's defining an LED color pair;

reflective white masking means for covering said surface of said substrate means and having openings therethrough whereby the area of said substrate surface in registry with said openings in said white masking means is exposed;

one electrical circuit path of said plurality including a first plurality of foil leaf areas arranged in a spaced relation to one another and defining a first electrical circuit path for physically and electrically connecting the anode of said first or second LED of one LED color pair and the cathode of the other of said first or second LED of said one LED color pair to one another and to said first electrical circuit path;

a second electrical circuit path of said plurality including a second plurality of foil leaf areas, a first portion of said plurality of foil leaf areas arranged in a spaced relation to one another and one-for-one with said first plurality of foil leaf areas defining said first electrical circuit path, said first portion of said second plurality of foil leaf areas comprising said second electrical circuit path and being electrically connected to the cathode of said first or second LED of said one LED color pair and the anode of the other of said first or second LED of said one LED color pair;

said second plurality of foil leaf areas including a second portion of foil leaf areas disposed generally oppositely said first portion and substantially in registry with said first plurality of foil leaf areas, said second portion of foil leaf areas being arranged in a spaced relation to one another and physically and electrically connecting the anode of said first or second LED of a second LED color pair and the cathode of the other of said first or second LED of said second LED color pair to one another and to said second electrical circuit path;

a third electrical circuit path of said plurality including a third plurality of foil leaf areas arranged in a spaced relation to one another and one-for-one with said second portion of foil leaf areas and substantially in registry with said first portion of foil leaf areas of said second plurality of foil leaf areas, said third plurality of foil leaf areas being electrically connected to the cathode of said first or second LED of said second LED color pair and the anode of the other of said first or second LED of said second LED color pair;

said one and second LED color pairs being located substantially in registry with said openings in said white masking means;

means defining a light frame extending generally in a direction away from said substrate surface and located along the peripheral marginal area of said substrate, said light frame including an interior wall surface extending in a direction generally away from said substrate surface and toward the peripheral marginal area of said substrate to form an outwardly slanting surface whereby light from said reflective white masking means and said first and second LED color pairs incident on said interior wall surface is directed upwardly away from said substrate surface, and means for diffusing light emitted by said first and second LED color pairs, said diffusing means further comprising diffusion tape disposed opposite said substrate surface and in contact with an upper peripheral edge surface of said light frame.

11. Apparatus as defined in claim 10 wherein said reflective white masking means comprises a layer of white ink.

12. Apparatus as defined in claim 10 wherein said reflective white masking means comprises a layer of white paint.

13. Apparatus as defined in claim 10 further comprising a plurality of one and second LED color pairs and forming a 2 row by N column matrix arrangement wherein N represents the number of electrical series circuits formed by the connection of said one and second LED color pairs.

14. Apparatus as defined in claim 11 further including means associated with said first and third electrical circuit paths for receiving a voltage potential whereby applying a voltage potential having a first polarity excites said LED color pair to produce a first color light and applying a voltage potential having a second polarity excites said LED color pair to produce a second color light and applying a voltage potential having an alternating polarity produces a third color light.

* * * * *

UNITED STATES PATENT AND TRADEMARK OFFICE

CERTIFICATE OF CORRECTION

PATENT NO. : 5,008,788

DATED : April 16, 1991

INVENTOR(S) : John M. Palinkas

It is certified that error appears in the above-identified patent and that said Letters Patent is hereby corrected as shown below:

COLUMN 5

Line 31, please delete "50" and substitute--42--.

Line 49, please delete "72" and substitute--73--.

COLUMN 7

Line 53, please delete "eclectically" and substitute --electrically--.

Signed and Sealed this

First Day of September, 1992

*Attest:*

DOUGLAS B. COMER

*Attesting Officer*

*Acting Commissioner of Patents and Trademarks*